US007429701B1

(12) United States Patent
Kushnir et al.

(10) Patent No.: US 7,429,701 B1
(45) Date of Patent: Sep. 30, 2008

(54) POWER CORD AUTOMATIC RETAINER

(75) Inventors: Eugene Kushnir, Pacifica, CA (US); Marius Popescu, Livermore, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 12 days.

(21) Appl. No.: 11/606,477

(22) Filed: Nov. 29, 2006

(51) Int. Cl.
*H01H 9/02* (2006.01)

(52) U.S. Cl. ..... 174/53; 174/54; 174/97; 174/154; 439/367; 24/139; 248/52

(58) Field of Classification Search ..... 174/53, 174/54, 59, 97, 154, 135; 439/367–373; 248/286.1, 52; 24/139, 336, 545; 220/3.3, 220/3.7

See application file for complete search history.

(56) References Cited

U.S. PATENT DOCUMENTS 4,045,108 A * 8/1977 Olsen ..... 439/368
5,593,313 A * 1/1997 Shibuya et al. ..... 439/373
6,071,142 A * 6/2000 Blackman ..... 439/373
6,767,237 B1 * 7/2004 Shih ..... 439/371

* cited by examiner

*Primary Examiner*—Dhiru R Patel
(74) *Attorney, Agent, or Firm*—Osha•Liang LLP

(57) ABSTRACT

A cord retaining apparatus includes a receptacle for receiving a head of a cord. A brack is mounted near the receptacle including an upper stop. An arm is pivotally attached to the bracket. A first length of the arm extends distal from the receptacle and a second length of the arm is substantially perpendicular to the first length. The arm is movable into and out of a position in which the second length is behind the head of the cord preventing removal of the cord. The upper stop prevents the arm from moving into a position where the arm does not naturally fall into the position behind the head of the cord.

7 Claims, 4 Drawing Sheets

POWER CORD AUTOMATIC RETAINER

BACKGROUND

As generally referred to in the art, a "server" is a computing device that is configured to perform operations for one or more other computing devices connected over a network. For an entity that requires computing infrastructure for handling relatively large amounts of network data, it is desirable to use servers that are designed to promote organizational/space efficiency and operational performance. In this regard, some servers are designed to be arranged in a "rack," whereby the rack (or "cabinet") houses numerous servers that are arranged, or "mounted," vertically one on top of another (however, not necessarily in contact with one another). Such a server is generally referred to in the art as a "rackmount" server. Referring to FIG. 1, rack 10 houses a plurality of servers 20.

Rackmount servers are generally designed having a height corresponding to whole multiples of an industry standard rack mounting height dimension. For example, rackmount servers are generally referred to as "2U," "3U," "4U," etc. systems, where the "U" designation refers to one dimensional increment of 1.75 inches in height along the vertical members of an Electronics Industry Alliance (EIA) industry-standard computer racking/mounting structure. Thus, for example, a 2U rackmount server is generally designed to be approximately 3.5 inches in height, less a small amount of clearance between vertically-adjacent rackmount servers in the rack (those skilled in the art will note that a standard rack is 19 inches wide; however, racks of other widths are available).

Rackmount servers may each require several power cords, as well as other types of cords, that connect to the back or front of the server chassis. As those skilled in the art will appreciate a completely connected set of rackmount servers will include many cords connected at various locations very near to one another. Accidental disconnection of a cord, especially a power cord, is an all too often occurrence that may negatively affect the server system or data.

SUMMARY OF INVENTION

In one aspect of one or more embodiments, a cord retaining apparatus comprises a receptacle for receiving a head of a cord and an arm movably mounted near the receptacle, wherein a first length of the arm extends distal from the receptacle and a second length of the arm is substantially perpendicular to the first length, and wherein the arm is movable into and out of a position in which the second length is behind the head of the cord preventing removal of the cord.

In one aspect of one or more embodiments, a cord retaining apparatus comprises a receptacle for receiving a cord, a blocking means for preventing removal of a head of the cord, and an attaching means for movably mounting the blocking means near the receptacle, wherein the blocking means is movable into and out of a position preventing removal of the cord.

Other aspects and advantages of the invention will be apparent from the following description and the appended claims.

DETAILED DESCRIPTION

Figure 1:
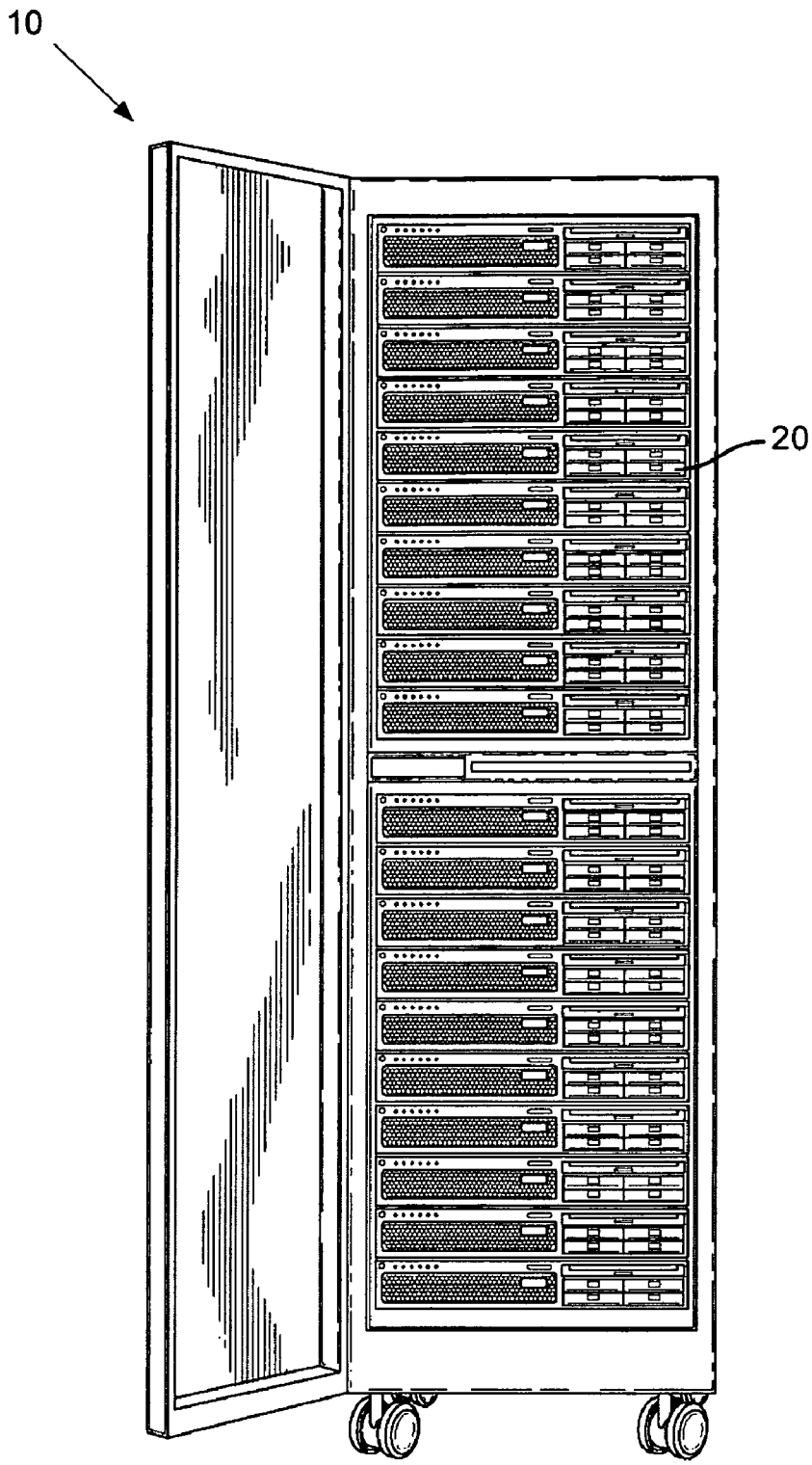
FIG. 1 (PRIOR ART)
FIG. 1 shows a typical rackmount server.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention relate to a cord retaining apparatus. More specifically, embodiments of the invention provide a cord retainer including an attachment member, such as a bracket, and a blocking member, such as an arm. A cord retainer is mounted nearby a receptacle for receiving a cord head. The attaching member may be installed near the receptacle such that the blocking member may be placed in a position to prevent removal of the cord head from the receptacle. Further, the blocking member may be movably attached to the attaching member such that it may be moved into and out of a position preventing removal of the cord head from the receptacle.

Figure 2:
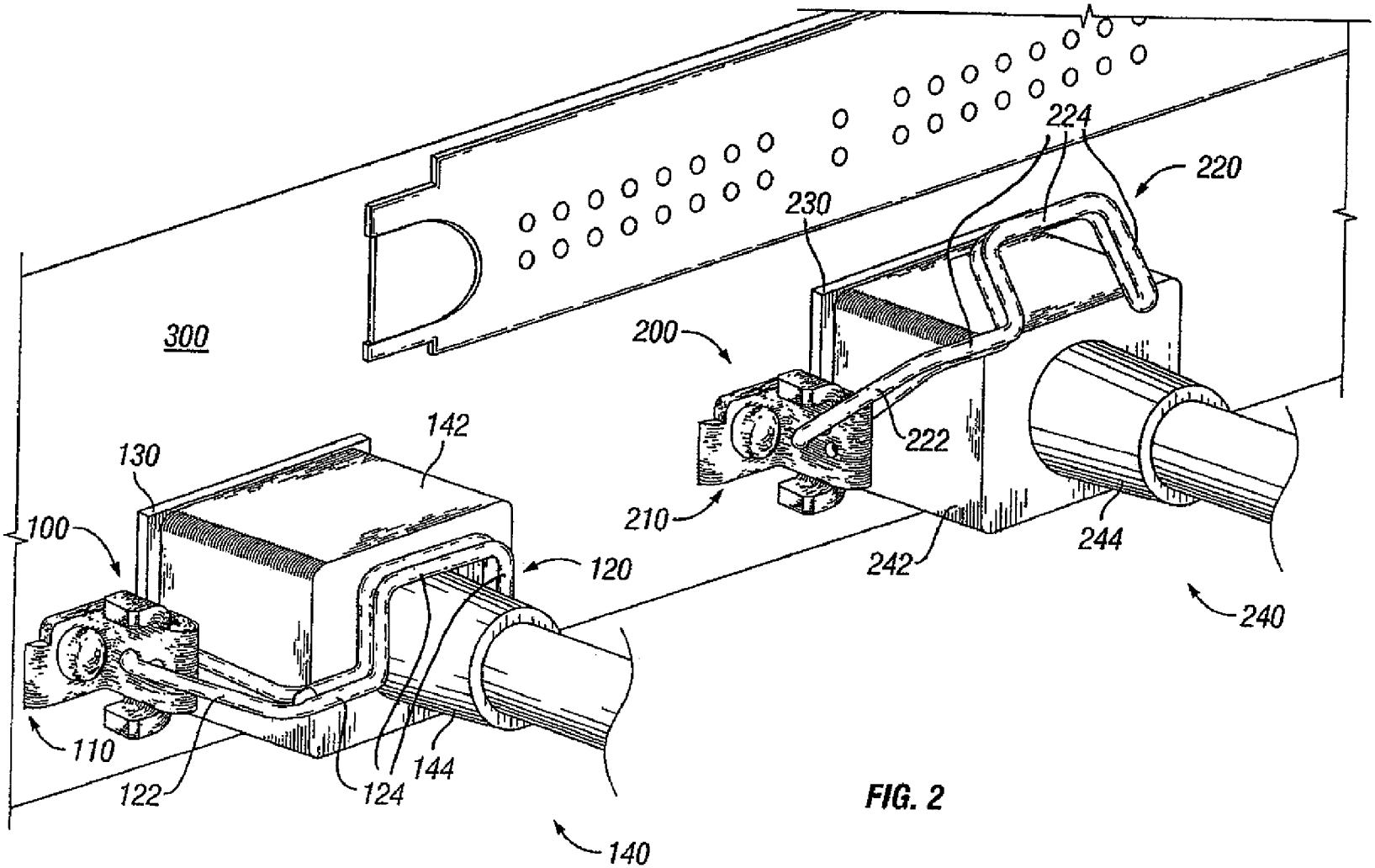
FIG. 2 shows cord retainer installed on a computer server in accordance with one or more embodiments of the present invention.

FIG. 2 shows a first cord retainer 100 in accordance with one or more embodiments of the present invention. The first cord retainer 100 includes a bracket 110 and an arm 120. The bracket 110 is installed on a back surface 300 of a computer server. The back surface 300 includes a first receptacle 130 for receiving a power cord head 142 of a first power cord 140. The bracket 110 of the first cord retainer 100 is installed next to the receptacle 130 such that the arm 120 may be placed in a secured position preventing removal of the power cord head 142 from the receptacle 130.

The arm 120 is movably attached to the bracket 110. A first length 122 of the arm 120 extends distally from the bracket 110, and a second length 124 of the arm 120 extends from, and substantially perpendicular to, the first length 122. Further, the first length 122 has a length such that when the arm 120 is in the secured position the second length 124 is behind the power cord head 142. Also, the second length 124 extends from the first length 122 in a substantially perpendicular direction such that the second length 124 is behind the power cord head 142. The second length 124 effectively blocks a backside of the power cord head 142. The arm 120 is not movable in a direction substantially normal to the receptacle. If the power cord head 142 is moved in a direction outwardly and away from the receptacle 130. Thus, the second length 124 of the arm 120 blocks the backside of the power cord head 142, thereby preventing removal of the first power cord 140.

Additionally, the second length 124 is shaped to block a significant portion of the backside of the power cord head 142. In the embodiment shown in FIG. 2, the second length 124 is shaped to partially enclose a strain relief part 144 of the first power cord 140. This allows the second length 124 to block a greater portion of the backside of the power cord head 142. Further, a part of the second length 124 may rest on the strain relief part 144 when the arm 120 is in the secured position. The arm 120 is shown in FIG. 2 in the secured position. Because a part of the second length 124 is resting on top of the strain relief part 144, the arm 120 is at rest in the secured position. In the secured position, at least a part of the second length 124 is blocking the backside of the power cord head 142.

FIG. 2 further shows a second cord retainer 200 in accordance with one or more embodiments of the present invention. Similar to the first cord retainer 100, the second cord retainer 200 includes a bracket 210 and an arm 220. The bracket 210 is installed on the back surface 300, which includes a second receptacle 230 for receiving a power cord head 242 of a second power cord 240. The bracket 210 of the second cord retainer 200 is installed next to the receptacle 230 such that the arm 220 may be placed in a secured position preventing removal of the power cord head 242 from the receptacle 230.

In contrast to the arm 120 of the first cord retainer 100, the arm 220 of the second cord retainer 200 is in an upward position and not the secured position. The arm 220 is pivoted upward from the secured position such that a second length 224 of the arm 220 is not blocking a backside of the power cord head 242. Because the second length 224 is not blocking the backside of the power cord head 242, the power cord head 242 may be removed from the receptacle 230. This upward position allows for insertion and removal of the power cord head 242 without having to remove the second cord retainer 200. The arms 120, 220 are easily movable into and out of a secured position, thereby allowing simple insertion and removal of the power cords 140, 240.

One or more embodiments may be designed to not allow the arms 120, 220 to be at rest in the upward position. In such a case, some deliberate force must be applied to lift the arms 120, 220 into the upward position where insertion and removal of the power cord head 142, 242 are allowed. Gravity naturally pulls the arms 120, 220 into the secured position. Consequently, as long as no deliberate force is applied to the arms 120, 220, then the arms 120, 220 remain in the secured position and accidental disconnection is avoided. One or more embodiments may be designed to such that the arms 120, 220 remain at any position. In such a case, some deliberate force must be applied to lift the arms 120, 220 into the upward position where insertion and removal of the power cord head 142, 242 is allowed and to lower the arms 120, 220 into the secured position.

Figure 3:
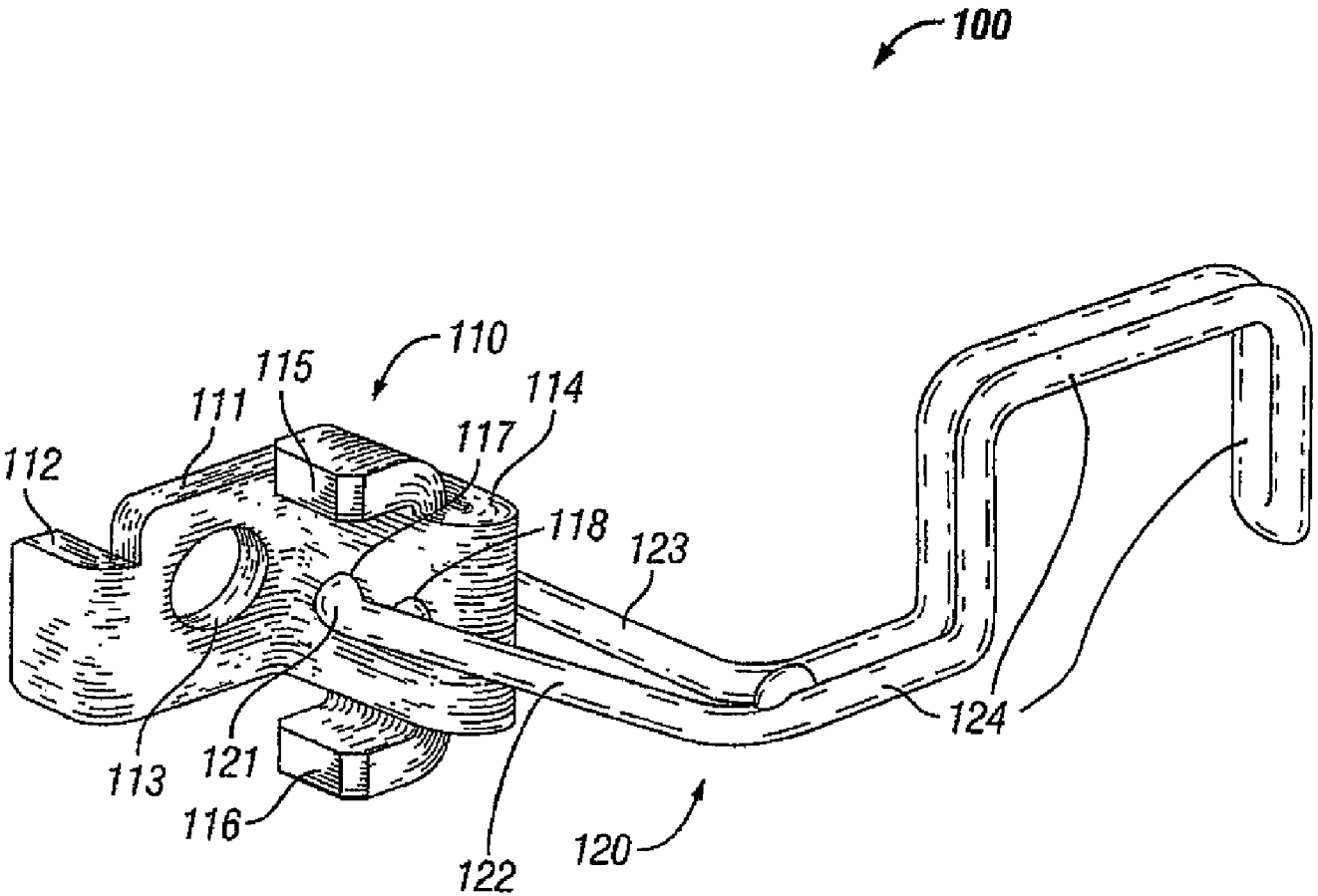
FIG. 3 shows a perspective view of a cord retainer in accordance with one or more embodiments of the present invention.
Figure 4:
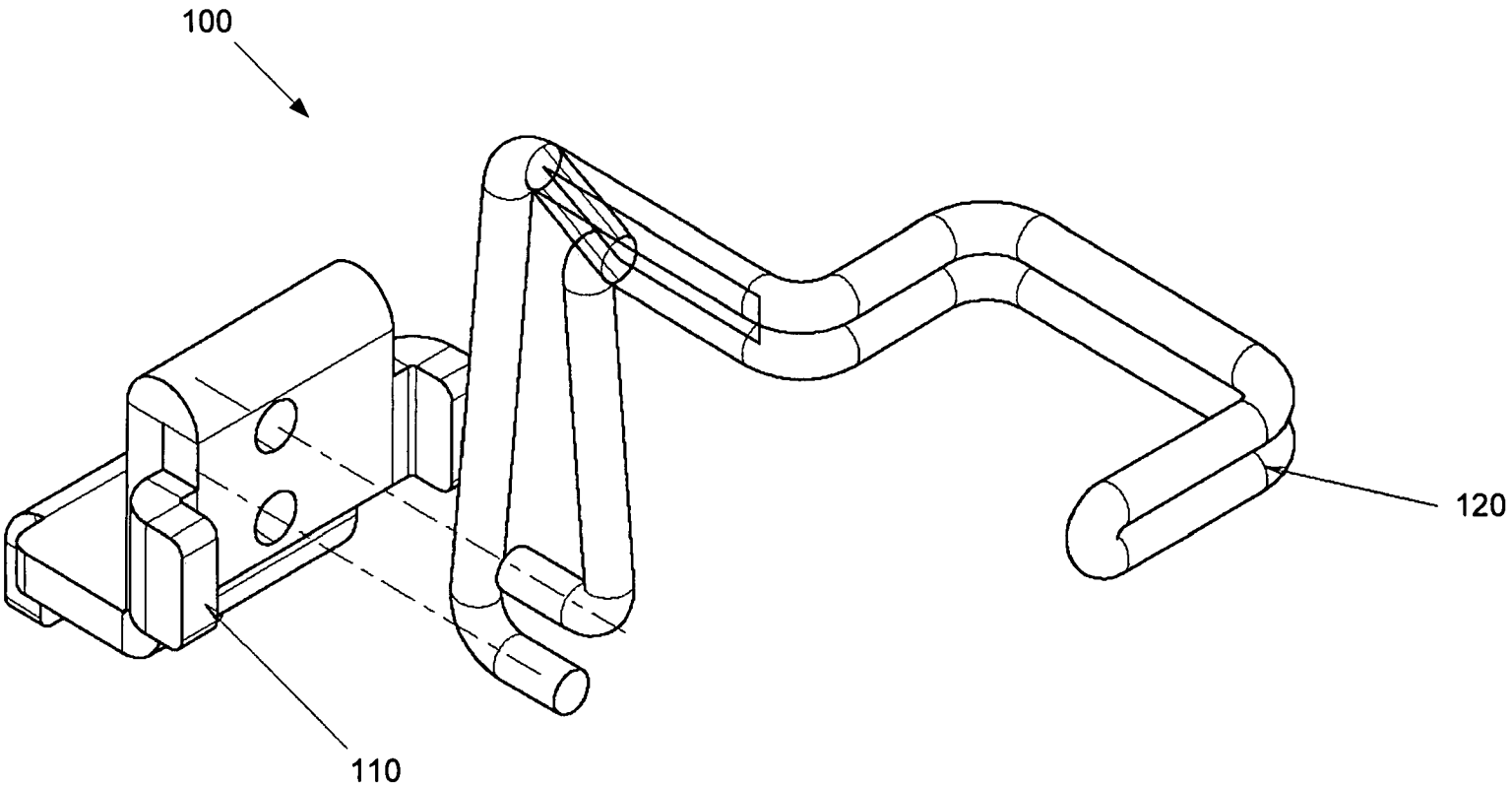
FIG. 4 shows an exploded view of a cord retainer in accordance with one or more embodiments of the present invention.

FIG. 3 shows a perspective view and FIG. 4 shows an exploded view of a cord retainer 100 in accordance with one or more embodiments of the present invention. Similar to FIG. 2, the cord retainer 100 includes a bracket 110 and an arm 120. Bracket 110 includes a mounting face 111 that interfaces with a mounting surface, such as the back surface 300 of the computer server in FIG. 2. Those skilled in the art will appreciate that the mounting surface may be any surface near a receptacle, which may include surfaces not on the computer server. Further, the bracket 110 may include a tab 112 to be inserted into a hole on the mounting surface. The tab 112 serves to guide placement of the bracket 110 on the mounting surface, and also may prevent sliding of the bracket 110. The bracket 110 also includes a first perforation 113 for inserting a fastener therethrough such that the bracket 110 may be fastened to the mounting surface. The fastener may include a screw, a bolt and nut, a pin, or any other suitable connector known in the art. Furthermore, the bracket 110 may alternatively be mounted to the mounting surface by adhesives, staking, spot welding, swaging, bonding, snaps, clamps, or other suitable attachment methods known in the art.

Bracket 110 further includes a protruding part 114 having a second perforation 117 and a third perforation 118 therethrough for mounting the arm 120. The arm 120 may be manufactured from one piece of wireform bent into a desired shape including the first length 122 and the second length 124. The arm 120 further includes a first end 121 and a second end 123. The first and second ends 121, 123 are disposed inside the second and third perforations 117, 118 such that the arm 120 is pivotally mounted to the bracket 110.

In the embodiment shown in FIGS. 3 and 4, the arm 120 is formed out of one continuous piece of wireform. Specifically, starting at the first end 121, the wireform is bent into the desired shape including the first and second lengths 122, 124. At the end of the second length 124, the wireform is doubled over and the second and first lengths 124, 122 are reformed, finishing at the second end 123 of the wireform. This double formation of the arm 120 provides rigidity and durability. Further, this double formation provides the two ends 121, 123 for mounting the arm 120 to the bracket 110.

Those skilled in the art will appreciate that the arm 120 may be made of metal, metal alloy, plastic, polymer, or any other suitable material known in the art. Further, the arm 120 may be manufactured from more than one piece of material. Additionally, the arm 120 may be alternatively mounted on the bracket 110, such as by only attaching one end of the arm 120 to the bracket 110 in a manner well known in the art.

In the embodiment shown in FIG. 3, the second length 124 of the arm 120 is shaped such that during use, the second length 124 effectively blocks the backside of a cord head. Specifically, a portion of the second length 124 is C-shaped. The C-shaped portion of the second length 124 provides a blocking surface that may come in contact with a peripheral surface of the backside of the cord head while partially enclosing a strain relief part of the cord. By partially enclosing the strain relief part of the cord, the C-shaped portion of the second length 124 may further serve to limit movement of the cord head. Those skilled in the art will appreciate that the second length 124, and the arm 120 in general, may be shaped differently depending on application. Furthermore, the second length 124 and the arm 120 may be shaped to block any surface of any type or number of cords.

Bracket 110 further includes an upper stop 115 and a lower stop 116. The upper stop 115 limits the movement of the arm 120. For example, the upper stop 115 may prevent the arm 120 from moving past a certain point in the upward position. Thus, in embodiments where a deliberate force is required to push the arm 120 into the upward position, the arm 120 will naturally fall into the secured position in the absence of such a force. The upper limit 115 prevents the arm 120 from moving past, for example, 90 degrees in the upward position where the arm 120 would not naturally fall into the secured position. Without the upper stop 115, the arm 120 could be moved into a position, for example, past 90 degrees in the upward position where the pull of gravity does not pull the arm 120 into the secured position.

The lower stop 116 may prevent the arm 120 from moving past a certain point in the downward position. For example, in embodiments where a deliberate force is required to push the arm 120 into the upward position, the lower stop 116 may prevent the arm 120 from falling so far into a downward position that connection of a cord is inconvenient. Those skilled in the art will appreciate that keeping the arm 120 within a smaller range of motion may add to the convenience of use in one or more embodiments. Additionally, the lower stop 116 provides greater manufacturability of the bracket 110. By providing both upper and lower stops 115, 116 the bracket 110 may be used as shown in FIGS. 2 and 3, or the bracket 110 may be rotated 180 degrees, wherein the lower stop 116 becomes an upper stop, and the upper stop 115 becomes a lower stop. Thus, an arm 120 configured for the bracket 110 could be mounted on the opposite side of the receptacle or could simply be retained by the upper and lower stops 115, 116 from the opposite side.

Those skilled in the art will appreciate that numerous variations of the disclosed embodiments may be devised without departing from the scope of the invention. For example, the arm may be slidably mounted on a bracket. In such an embodiment, the arm slides into and out of a position preventing removal of a cord head from a receptacle. Furthermore, the arm does not have to be movably mounted to the bracket. Rather, the bracket may be movably mounted to a surface near a receptacle, and the arm may be statically attached to the bracket. In such an embodiment, the bracket would slide, pivot, or otherwise move into and out of a position preventing removal of a cord.

Additionally, it is not required that the arm is mounted to a bracket. Rather, the arm may be directly, movably mounted to a surface near a receptacle. For example, an attachment member for movably mounting the arm may be integrally formed with a surface near a receptacle. More specifically, a part of the surface may be formed or molded to include an attachment site for movably mounting the arm. Alternatively, the arm may be designed such that, for example, an engagement portion is included on the arm that movably engages a slot formed in a surface near a receptacle.

Further, the cord retainer need not be mounted next to a receptacle. Instead, the cord retainer may be mounted anywhere near the receptacle so long as the cord retainer is designed to move into and out of a position for preventing removal of the cord. For example, the bracket may be mounted to a side surface of a computer server, and the arm may extend to the back surface to move into and out of the secured position.

One or more embodiments of the present invention may include one or more of the following advantages. Cords attached to the server system, especially power cords, are secured against accidental disconnection. Cords are secured easily at insertion and require deliberate, but simple, removal. The construction of one or more embodiments of cord retainer is simple and inexpensive. The design of one or more embodiments of cord retainer allows retrofitting of the device onto existing systems and easy integration into new systems.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cord retaining apparatus comprising:

a receptacle for receiving a head of a cord;

a bracket mounted near the receptacle comprising an upper stop; and an arm pivotally attached to the bracket, wherein a first length of the arm extends distal from the receptacle and a second length of the arm is substantially perpendicular to the first length;

wherein the arm is movable into and out of a position in which the second length is behind the head of the cord preventing removal of the cord; and wherein the upper stop prevents the arm from moving into a position where the arm does not naturally fall into the position behind the head of the cord.

2. The cord retaining apparatus of claim 1, wherein the upper stop limits movement of the arm to less than 90 degrees from the position in which the second length is behind the head of the cord.

3. The cord retaining apparatus of claim 1, wherein the second length of the arm is shaped to block at least a portion of a back surface of the head of the cord.

4. The cord retaining apparatus of claim 1, wherein the second length of the arm comprises a c-shaped section.

5. The cord retaining apparatus of claim 4, wherein the c-shaped section at least partially encloses a protrusion on the head of the cord.

6. The cord retaining apparatus of claim 1, wherein the second length of the arm comprises a c-shaped section that at least partially encloses a protrusion on the head of the cord.

7. The cord retaining apparatus of claim 1, wherein the bracket further comprises a lower stop.

* * * * *